US008837959B2

(12) United States Patent
Otsuka et al.

(10) Patent No.: US 8,837,959 B2
(45) Date of Patent: Sep. 16, 2014

(54) IMAGE FORMING DEVICE AND METHOD OF ADJUSTING DENSITY OF FORMED IMAGE

(75) Inventors: Tatsuhiro Otsuka, Suwon-si (KR); Soon-cheol Kweon, Seoul (KR); Ki-hwan Kwon, Hwaseong-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 564 days.

(21) Appl. No.: 12/908,527

(22) Filed: Oct. 20, 2010

(65) Prior Publication Data

US 2011/0182605 A1 Jul. 28, 2011

(30) Foreign Application Priority Data

Jan. 27, 2010 (KR) ..... 10-2010-0007446

(51) Int. Cl.
*G03G 15/08* (2006.01)

(52) U.S. Cl.
CPC ..... *G03G 15/0824* (2013.01); *G03G 15/0825* (2013.01); *G03G 15/0829* (2013.01)
USPC ..... 399/27; 399/30; 399/55; 399/58; 399/61; 399/63

(58) Field of Classification Search
CPC ..... G03G 15/0824; G03G 15/0825; G03G 15/0827; G03G 15/0829; G03G 15/0849; G03G 15/0851; G03G 15/0853; G03G 15/0855
USPC ..... 399/27, 30, 53, 55, 58, 61–63, 258–260
See application file for complete search history.

(56) References Cited

U.S. PATENT DOCUMENTS

| | | | | |
|---|---|---|---|---|
| 4,524,088 | A * | 6/1985 | Fagen et al. | |
| 5,974,280 | A * | 10/1999 | Takesue et al. | 399/62 |
| 2006/0008281 | A1 * | 1/2006 | Matsumoto et al. | 399/27 |
| 2008/0044190 | A1 * | 2/2008 | Silence | 399/27 |

FOREIGN PATENT DOCUMENTS

JP 2000-147877 5/2000

* cited by examiner

*Primary Examiner* — David Gray
*Assistant Examiner* — Laura Roth
(74) *Attorney, Agent, or Firm* — Stanzione & Kim, LLP

(57) ABSTRACT

An image forming device includes a toner supplying unit to supply the toner to a storage unit. A mixer supplies developer in the storage unit to a developing roller, and a developer sensor detects the amount of developer on the surface of the developing roller. A toner concentration sensor detects toner concentration in the developer stored in the storage unit, and a control unit adjusts at least one of a developing bias and a rotation speed of the mixer based on a value detected by the developer sensor and a value detected by the toner concentration sensor, such that a printed image has uniform density.

14 Claims, 14 Drawing Sheets

IMAGE FORMING DEVICE AND METHOD OF ADJUSTING DENSITY OF FORMED IMAGE

CROSS-REFERENCE TO RELATED APPLICATIONS

This application claims the benefit of priority under 35 U.S.C. §119 to Korean Patent Application No. 10-2010-0007446, filed on Jan. 27, 2010, in the Korean Intellectual Property Office, the disclosure of which is incorporated herein in its entirety by reference.

BACKGROUND

1. Field of the Invention

The present general inventive concept relates to an image forming device employing a two-component developer including toner and a magnetic carrier and a method of adjusting image density thereof.

2. Description of the Related Art

An electrophotographic image forming device prints an image onto a printing medium by irradiating light modulated in correspondence to image information to a photosensitive body to form an electrostatic latent image on a surface of the photosensitive body, develops the electrostatic latent image to form a visible toner image by supplying toner to the electrostatic latent image, and transferring and fixing the toner image onto the printing medium.

Image forming methods used by electrophotographic image forming devices may include a mono-component development method, in which a mono-component developer including toner is used, and a two-component development method, in which a two-component developer, which is a mixture of toner and a carrier, is used, and only the toner is developed to a photosensitive body.

SUMMARY

The present general inventive concept provides an image forming device employing a two-component developer including toner and a magnetic carrier and a method of adjusting image density thereof to provide a constant image density.

The present general inventive concept also provides an image forming device and a method of adjusting image density thereof to prevent image density errors due to erroneous detection of a toner concentration sensor.

Additional aspects and utilities of the present general inventive concept will be set forth in part in the description which follows and, in part, will be obvious from the description, or may be learned by practice of the present general inventive concept.

Features and/or utilities of the present general inventive concept may be realized by an image forming device to print an image by receiving a developer including toner and a magnetic carrier from a storage unit, to form a developer layer on a surface of a developing roller by using the developer, and to move and adhere the toner from the developer layer to a photosensitive body by applying developing bias to the developing roller. The image forming device may include a toner supplying unit to supply the toner to the storage unit, a mixer to supply the developer in the storage unit to the developing roller, a developer sensor to detect the amount of developer on the surface of the developing roller, a toner concentration sensor to detect toner concentration in the developer stored in the storage unit, and a control unit to adjust at least one of a developing bias and a rotation speed of the mixer based on a value detected by the developer sensor and a value detected by the toner concentration sensor, such that a printed image has uniform density.

If the detected amount of the developer is outside a normal range and the detected toner concentration is within a normal range, the control unit may adjust at least one of the developing bias and the rotation speed of the mixer.

If both the detected amount of the developer and the detected toner concentration are outside the normal ranges, the control unit may control the toner supplying unit to supply new toner to the storage unit, detect toner concentration again by using the toner concentration sensor, detect the amount of the developer again by using the developer sensor if the re-detected toner concentration is within the normal range, and adjust at least one of the developing bias and the rotation speed of the mixer if the re-detected amount of the developer is outside the normal range.

If one of the developing bias and the rotation speed of the mixer is outside an adjustable range, the control unit may adjust the other one of the developing bias and the rotation speed of the mixer.

Features and/or utilities of the present general inventive concept may also be realized by a method of adjusting image density for an image forming device to print an image by receiving a developer including toner and a magnetic carrier from a storage unit, forming a developer layer on a surface of a developing roller by using the developer, and moving and adhering the toner from the developer layer to a photosensitive body by applying a developing bias to the developing roller. The method may include detecting the amount of developer on the surface of the developing roller by using a developer sensor, detecting toner concentration in the developer stored in the storage unit by using a toner concentration sensor, and adjusting at least one of the developing bias and a rotation speed of a mixer based on a value detected by the developer sensor and a value detected by the toner concentration sensor, such that a printed image has uniform density.

The adjusting of at least one of the developing bias and the rotation speed of the mixer may include adjusting at least one of the developing bias and the rotation speed of the mixer if the detected amount of the developer is outside a normal range and the detected toner concentration is within a normal range.

The adjusting of at least one of the developing bias and the rotation speed of the mixer may include supplying new toner to the storage unit if both the detected amount of the developer and the detected toner concentration are outside the normal ranges, detecting toner concentration again by using the toner concentration sensor, detecting the amount of the developer again by using the developer sensor, if the re-detected toner concentration is within the normal range, and adjusting at least one of the developing bias and the rotation speed of the mixer, if the re-detected amount of the developer is outside the normal range.

The adjusting of at least one of the developing bias and the rotation speed of the mixer may include adjusting one of the developing bias and the rotation speed of the mixer if the other one of the developing bias and the rotation speed of the mixer is outside an adjustable range.

The developer sensor may be a capacitive sensor to detect a thickness of the developer layer, and the toner concentration sensor may be a magnetic sensor to detect concentration of the toner indirectly by detecting the amount of the magnetic carrier.

A plurality of the developer sensors may be arranged in a lengthwise direction of the developing roller.

Adjusting the at least one of the rotation speed of the mixer and the developing bias may include, if the developer amount is detected as normal, not adjusting either of the rotation speed of the mixer and the developing bias, and if the developer amount is detected as abnormal and the toner concentration is detected as normal, adjusting one of the rotation speed of the mixer and the developing bias until the developer amount is detected as normal. If the one of the rotation speed of the mixer and the developing bias is adjusted to a limit of a normal operating range and the developer amount is still detected as abnormal, the method may include adjusting the other of the mixer speed and the developing bias until the developer amount is detected as normal.

If the developer amount is detected as abnormal and the toner concentration is detected as abnormal, then the method may further include, before adjusting the one of the rotation speed of the mixer and the developing bias, adjusting an amount of toner supplied to the storage area until the toner concentration is detected as normal.

Detecting an amount of developer may include averaging a plurality of detected amounts of developer from a plurality of developer sensors.

Features and/or utilities of the present general inventive concept may also be realized by an image forming device including a storage area to store developer including toner and carrier, a toner concentration sensor to detect a toner concentration level in the storage area, a developing roller to transmit toner from the storage area to a printing medium, a developer sensor to detect an amount of developer on an outer surface of the developing roller, a mixer to mix the developer in the storage area and to supply the developer to the developing roller, and a control unit to receive detection signals from each of the toner concentration sensor and the developer sensor and to adjust at least one of a developing bias of the developing roller and a mixing speed of the mixer according to the received detection signals.

If the developer sensor detects a normal amount of developer, the control may not adjust either of the mixing speed or the developing bias to adjust an image density of an image on the printing medium, and if the developer sensor detects an abnormal amount of developer, the controller may adjust one of the developing bias and the mixing speed until the developer sensor detects a normal amount of developer. If the one of the developing bias and the mixing speed is adjusted to a limit of a normal operating range and the developer sensor still detects an abnormal developer amount, then the control unit may adjust the other of the developing bias and the mixing speed until the developer sensor detects a normal amount of developer.

The image forming device may further include a toner supply controller to control an amount of toner supplied to the storage area. If the developer sensor detects an abnormal amount of developer and the toner concentration sensor detects an abnormal concentration of toner, the control unit may control the toner supply controller to adjust an amount of toner supplied to the storage area, and if the developer sensor detects an abnormal amount of developer and the toner concentration sensor detects a normal concentration of toner, the controller may adjust one of the developing bias and the mixing speed until the developer sensor detects a normal amount of developer. If the one of the developing bias and the mixing speed is adjusted to a limit of a normal operating range and the developer sensor still detects an abnormal developer amount, then the control unit may adjust the other of the developing bias and the mixing speed until the developer sensor detects a normal amount of developer.

The developer sensor may include a plurality of developer sensors extending in a length direction of the developing roller.

BRIEF DESCRIPTION OF THE DRAWINGS

The above and other features and advantages of the present general inventive concept will become more apparent by describing in detail exemplary embodiments thereof with reference to the attached drawings in which.

DETAILED DESCRIPTION OF THE EMBODIMENTS

Figure 1A:
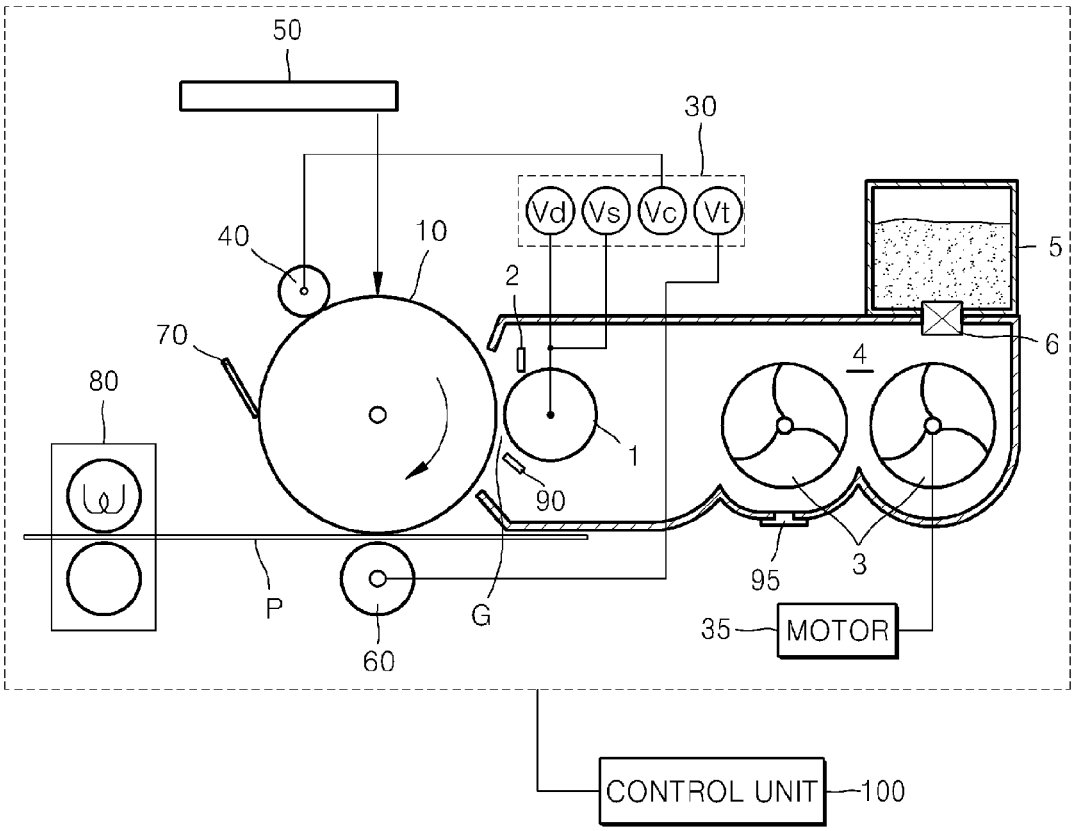
FIGS. 1A-1C are schematic views of an image forming device according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1A is a schematic view of an image forming device according to an embodiment of the present general inventive concept. The image forming device according to the present embodiment is a monochrome image forming device employing a two-component developer, which contains toner and a magnetic carrier. The color of the toner may be black, for example.

A photosensitive drum 10 is an example of a photosensitive body on which an electrostatic latent image is formed, and the photosensitive drum 10 is formed by forming a photosensitive layer, which exhibits photoconductivity, on the outer surface of a metal cylinder. Alternatively, a photosensitive belt having a photosensitive layer on its outer surface may be used instead of the photosensitive drum 10.

Figure 2:
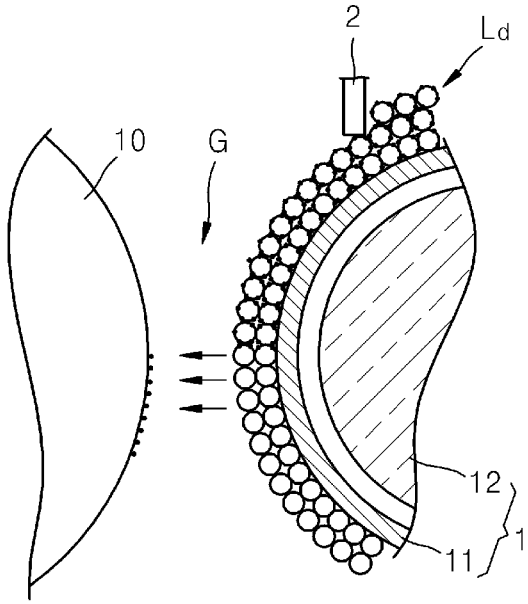
FIG. 2 is a diagram showing a developing process performed by the image forming device shown in FIG. 1A.

A developing roller 1 is positioned such that the outer surface of the developer roller 1 faces the outer surface of the photosensitive drum 10. A developing gap G may be formed between the developing roller 1 and the photosensitive drum 10. The developing gap G may be from tens of microns to hundreds of microns, and may be from about 150 μm to about 400 μm. Referring to FIG. 2, the developing roller 1 may include a rotating sleeve 11 and a magnet 12 installed inside the sleeve 11. A developer to form an image may include a carrier which may have a magnetic property and toner which is the part of the developer that attaches to a print medium P to form an image on the print medium P. The carrier is attached to the outer surface of the developing roller 1 due to magnetic force of the magnet 12, and toner is attached to the carrier due to an electrostatic force. As a result, a developer layer Ld, which is formed of the carrier and toner, is formed on the outer surface of the developing roller 1 as shown in FIG. 2.

The restriction member 2 restricts the thickness of the developer layer Ld to a predetermined thickness. The interval between the restriction member 2 and the developing roller 1 may be from about 0.3 mm to about 1.5 mm.

The developer is stored in a storage unit 4. A mixer 3 supplies the developer to the developing roller 1. Furthermore, the mixer 3 mixes toner and carrier and frictionally charges the toner. The toner may be charged negatively or positively. Although there are two mixers 3 shown in FIG. 1A, the present general inventive concept is not limited thereto, and either only one mixer 3 or three or more mixers 3 may be disposed in the storage unit 4.

A toner supplying unit 5 stores toner to be supplied to the storage unit 4. The toner supply from the toner supplying unit 5 to the storage unit 4 may be controlled by a toner supplying controller 6. The toner supplying controller 6 may be a shutter interposed between the toner supplying unit 5 and the storage unit 4, for example. Alternatively, the toner supplying controller 6 may be a means of transportation, such as an auger to transport toner from the toner supplying unit 5 to the storage unit 4, for example.

A charging roller 40 is an example of chargers to charge the surface of the photosensitive drum 10 with a uniform charge potential. A charging bias Vc is applied to the charging roller 40. Instead of the charging roller 40, a corona charger, which utilizes corona discharging, may be used.

An exposure unit 50 forms an electrostatic latent image on the charged surface of the photosensitive drum 10 by irradiating light corresponding to image information. As an example of the exposure unit 50, a laser scanning unit (LSU), which deflects light irradiated from a laser diode by using a polygonal mirror in the main scanning direction and irradiates the deflected light to the photosensitive drum 10, may be used.

A transferring bias Vt is applied to a transferring roller 60. Due to a transferring electric field formed between the photosensitive drum 10 and the transferring roller 60 by the transferring bias Vt, a toner image developed on the surface of the photosensitive drum 10 is transferred to a printing medium P. Instead of the transferring roller 60, a corona transferring unit, which utilizes corona discharging, may be used.

The toner image transferred to the printing medium P is adhered to the printing medium P with an electrostatic force. A fixing unit or fusing unit 80 fixes or fuses the toner image to the printing medium P by applying heat and pressure.

A power supply unit 30 supplies the developing bias Vd, charging bias Vc, and transferring bias Vt to the developing roller 1, the charging roller 40, and the transferring roller 60, respectively.

When charging bias Vc is applied to the charging roller 40, the surface of the photosensitive drum 10 is charged with uniform charge potential. The exposure unit 50 forms an electrostatic latent image on the charged surface of photosensitive drum 10 by irradiating light corresponding to image information. When the developing bias Vd is applied to the developing roller 1 and a developing electric field is formed between the developing roller 1 and the photosensitive drum 10, toner moves from a developer layer Ld formed on the surface of the developing roller 1 to the surface of the photosensitive drum 10 and develops the electrostatic latent image. A toner image is formed on the surface of the photosensitive drum 10. A printing medium P in a medium supplying unit (not shown) is supplied to an area between the surface of the photosensitive drum 10 and the surface of the transferring roller 60. Due to transferring electric field formed by transferring bias Vt, the toner image moves from the surface of the photosensitive drum 10 to the printing medium P and is adhered to the surface of the printing medium P. When the printing medium P passes through the fixing unit 80, the toner image is fixed to the printing medium P due to heat and pressure, and thus an image printing is completed. A cleaning blade 70 contacts the surface of the photosensitive drum 10 and removes toner remaining on the surface of the photosensitive drum 10 after the transferring operation.

Referring to FIG. 1A, the storage unit 4 includes a toner concentration sensor 95 to detect the concentration of toner in a developer stored in the storage unit 4. The toner concentration sensor 95 may be a magnetic sensor, for example. The storage unit 4 stores a mixture of toner and a magnetic carrier. The concentration of the toner may be indirectly detected by detecting the amount of the magnetic carrier by using a magnetic sensor. In other words, if the amount of toner is relatively large in a region detected by a magnetic sensor, the amount of the magnetic carrier is relatively small, and thus the output of the magnetic sensor decreases. On the contrary, if the amount of toner is relatively small in a region detected by a magnetic sensor, the amount of the magnetic carrier is relatively large, and thus the output of the magnetic sensor increases. Therefore, toner concentration sensor 95 may indirectly detect the concentration of the toner by detecting the amount of the magnetic carrier within a predetermined space.

Figure 12A:
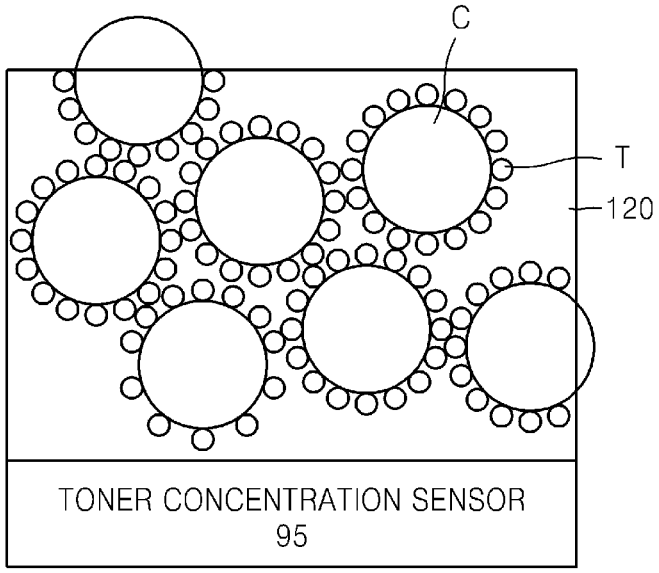
FIGS. 12A and 12B illustrate detecting toner concentration.
Figure 12B:
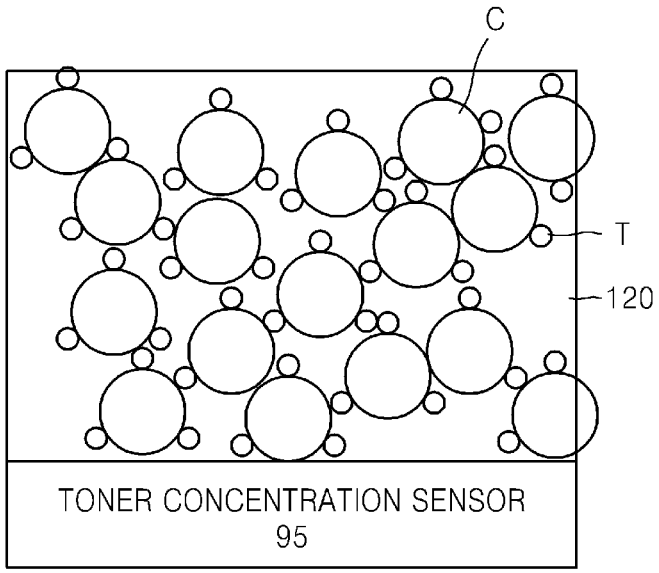

For example, as illustrated in FIG. 12A, if the concentration of toner particles T in a predetermined detection area 120 is relatively high, then the concentration of carrier particles C in the same area is relatively low. On the other hand, as illustrated in FIG. 12B, if the concentration of toner particles T in the predetermined detection area 120 is relatively low, then the concentration of carrier particles C in the predetermined area is relatively high.

Figure 1B:
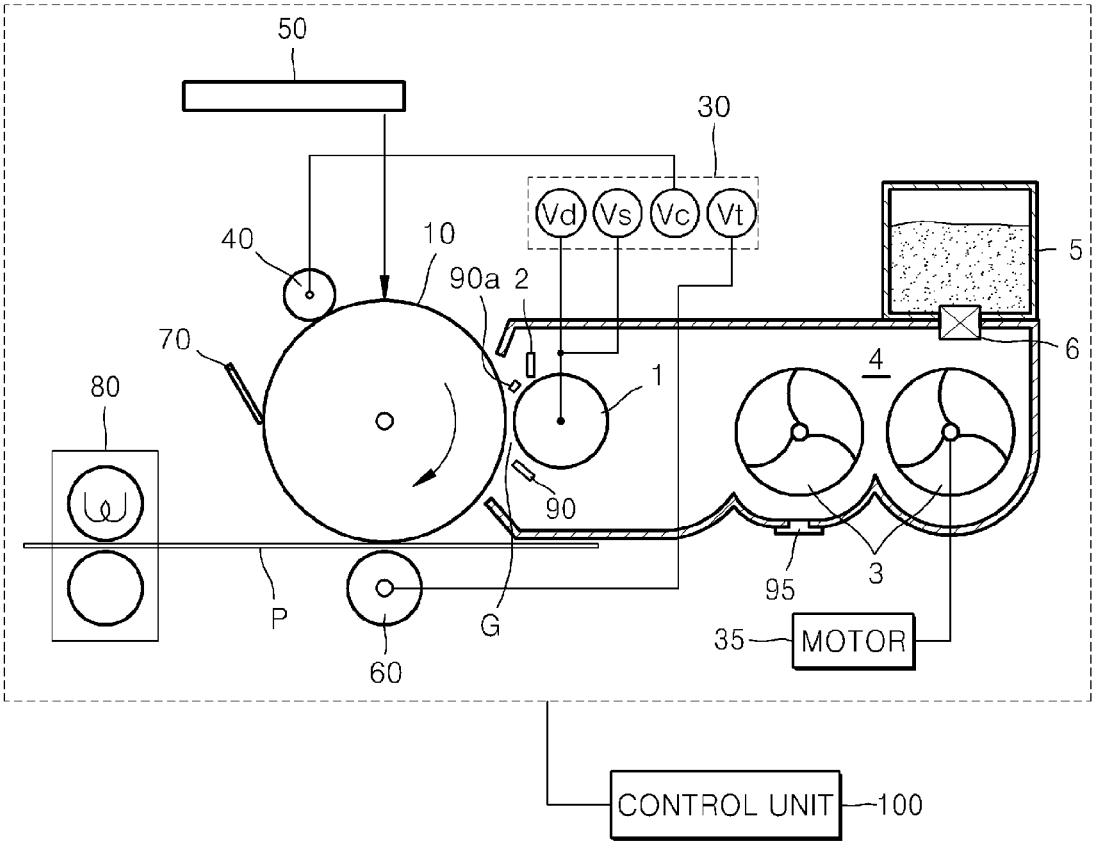
Figure 1C:
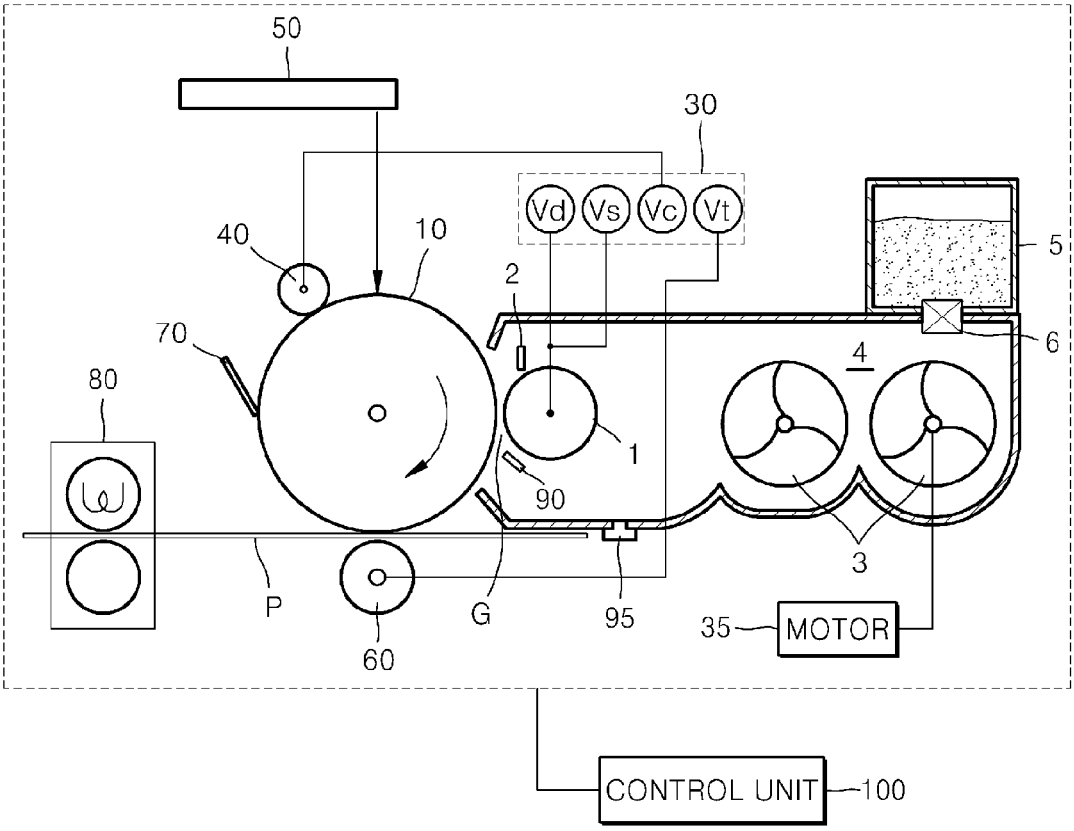

The toner concentration sensor 95 may be located at any position within the storage unit 4. For example, FIG. 1A illustrates the toner concentration sensor 95 positioned between two mixers 3, and FIG. 1C illustrates the toner concentration sensor 95 positioned between a mixer 3 and the developing roller 1.

To provide uniform image density, it is necessary to maintain a constant concentration of toner in the storage unit 4 and a constant amount of developer adhered to the surface of the developing roller 1 and transported to the developing gap G. The concentration of toner is the ratio of the amount of the toner with respect to the amount of the developer (or toner and carrier) in the storage unit 4. The amount of the developer may be expressed as the amount of the developer per unit area, for example. This is referred to as a developer mass per area (DMA). When concentration of toner in developer supplied from the storage unit 4 increases or decreases, the DMA also increases or decreases. To maintain the concentration of toner in the storage unit 4 within a desired range, a control unit 100 may control the toner supplying controller 6 based on a value detected by the toner concentration sensor 95 to control the amount of toner supplied from the toner supplying unit 5 to the storage unit 4. In other words, when the toner concentration is low, the control unit 100 may control the toner supplying controller 6 to supply toner from the toner supplying unit 5 to the storage unit 4. Accordingly, the DMA may be maintained constant.

Figure 4:
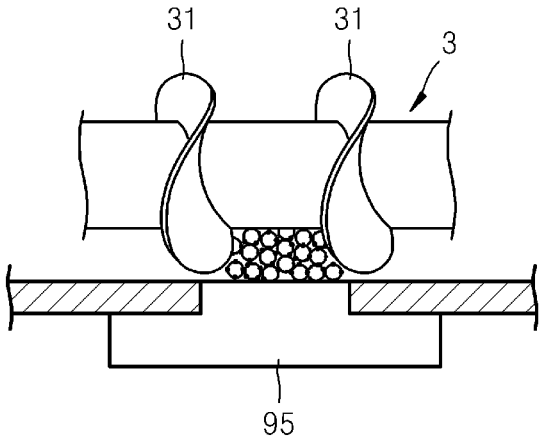
FIGS. 4-7 are diagrams showing examples of errors in the case where a magnetic sensor is used as a toner concentration sensor.
Figure 5:
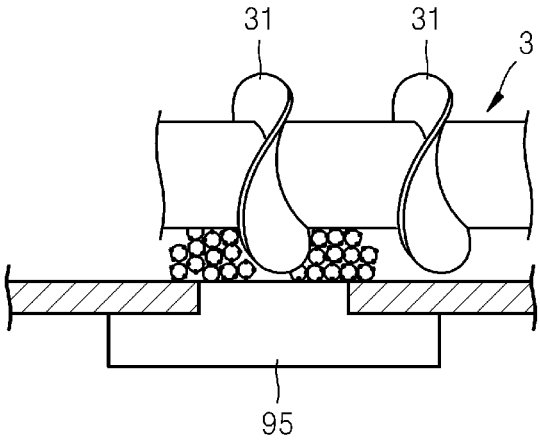

However, if there are errors in values detected by the toner concentration sensor 95 then the actual toner concentration may be different from the detected concentration. For example, as shown in FIG. 4, when an auger including spiral mixing wings 31 is employed as the mixer 3 and a region detected by the toner concentration sensor 95 is located between the mixing wings 31, the magnetic carrier particles may be highly concentrated in the region of detection, and thus the concentration of toner may be detected as being relatively low. Meanwhile, as shown in FIG. 5, when the mixing wings 31 are located in the region detected by the toner concentration sensor 95, the toner concentration sensor 95 may detect a lower concentration of carrier in the region of detection, and thus the concentration of toner may be detected as relatively high.

Figure 6:
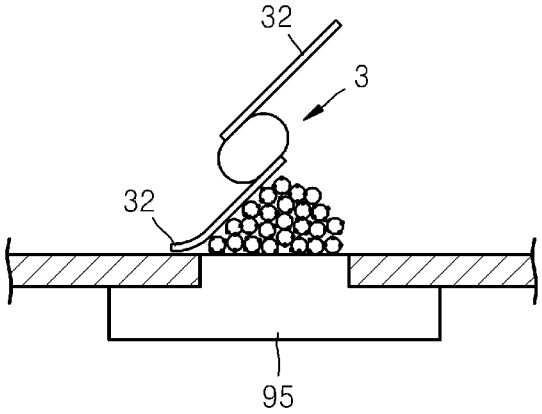
Figure 7:
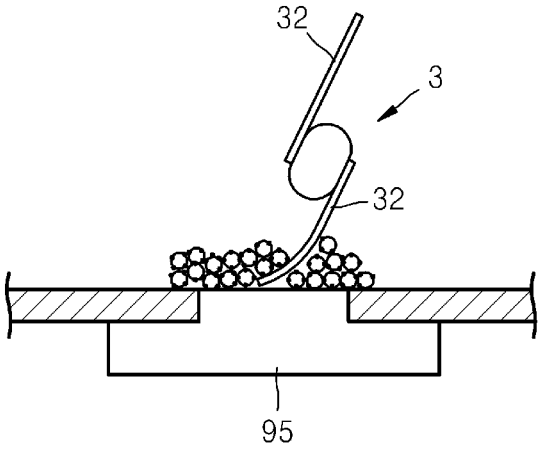

Similarly, when the mixer 3 having a plurality of film-like mixing wings 32 is employed as shown in FIG. 6, the magnetic carrier may be highly concentrated in a region detected by the toner concentration sensor 95 while the mixing wings 32 transport developer to the region of detection, and thus the concentration of toner may be detected as relatively low. Meanwhile, when the mixing wings 32 are located in the region detected by the toner concentration sensor 95, then the toner concentration sensor 95 may detect a lower concentration of carrier in the region of detection, and thus the concentration of toner may be detected as relatively high. Furthermore, over time the carrier may lose its magnetic charge, which may result in errors in the detection of the concentration of toner in the storage unit 4.

Therefore, there may be cases in which DMA cannot be maintained constant based on values detected by the toner concentration sensor 95, and thus image density may not be constant.

Referring to FIG. 1A, a developer sensor 90 may be provided to detect the amount of developer adhered to the surface of the developing roller 1 and supplied to a developing region facing the surface of the photosensitive drum 10. The developer sensor 90 may be located downstream of the restriction member 2 relative to the rotation direction of the developing roller 1 to detect the amount of developer. The sensor 90 may be located on the downstream side of the developing region as illustrated in FIG. 1A, or on the upstream side of the developing region of the developing region. Also, sensors 90*a* and 90 may be located in either the upstream side and downstream side of the developing region as illustrated in FIG. 1B.

The developer sensor 90 may be a photosensor, for example. However, since diffused reflection occurs on the surface of the developing roller 1 or in a developer layer Ld, there may be errors in the detection performed by a photosensor. Therefore, according to the present embodiment, the developer sensor 90 is a capacitive sensor. A capacitive sensor is a sensor utilizing the principle that capacity of a condenser depends on an interval between two plates facing each other and permittivity of a material existing in the interval.

Figure 3:
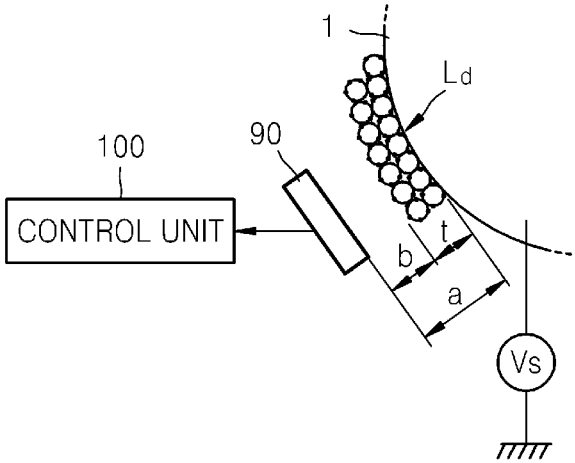
FIG. 3 is a diagram showing that amount of developer is detected by a developer sensor.

For example, as shown in FIG. 3, the developer sensor 90 is located a predetermined distance "a" apart from the surface of the developing roller 1. For example, a pulse voltage of charging roller 40 V and 10 KHz may be applied to the developing roller 1 as a detecting voltage Vs. The detecting voltage Vs may be supplied from the power supply unit 30. When a developer layer Ld formed on the surface of the developing roller 1 faces the developer sensor 90 as the developing roller 1 rotates, the capacity of the developer sensor 90 is changed. At this point, a distance "b" between the developer sensor 90 and the developer layer Ld may be obtained based on the output of the developer sensor 90. The thickness t of the developer layer Ld may be obtained based on a-b. DMA may be calculated based on the thickness "t" of the developer layer Ld. Practically, DMA may be obtained by obtaining a relationship equation via linear approximation of a relationship between the DMA and the output of the developer sensor 90 and applying the output of the developer sensor 90 to the relationship equation.

The control unit 100 may control the amount of toner developed from the developing roller 1 to the photosensitive drum 10 and/or may control the amount of developer supplied from the storage unit 4 to the developing roller 1 based on values detected by the toner concentration sensor 95 and the developer sensor 90, such that density of a printed image is constant. The amount of toner developed from the developing roller 1 to the photosensitive drum 10 may be adjusted by controlling the developing bias Vd. The amount of developer supplied from the storage unit 4 to the developing roller 1 may be adjusted by controlling a rotation speed of the mixer 3.

Figure 8:
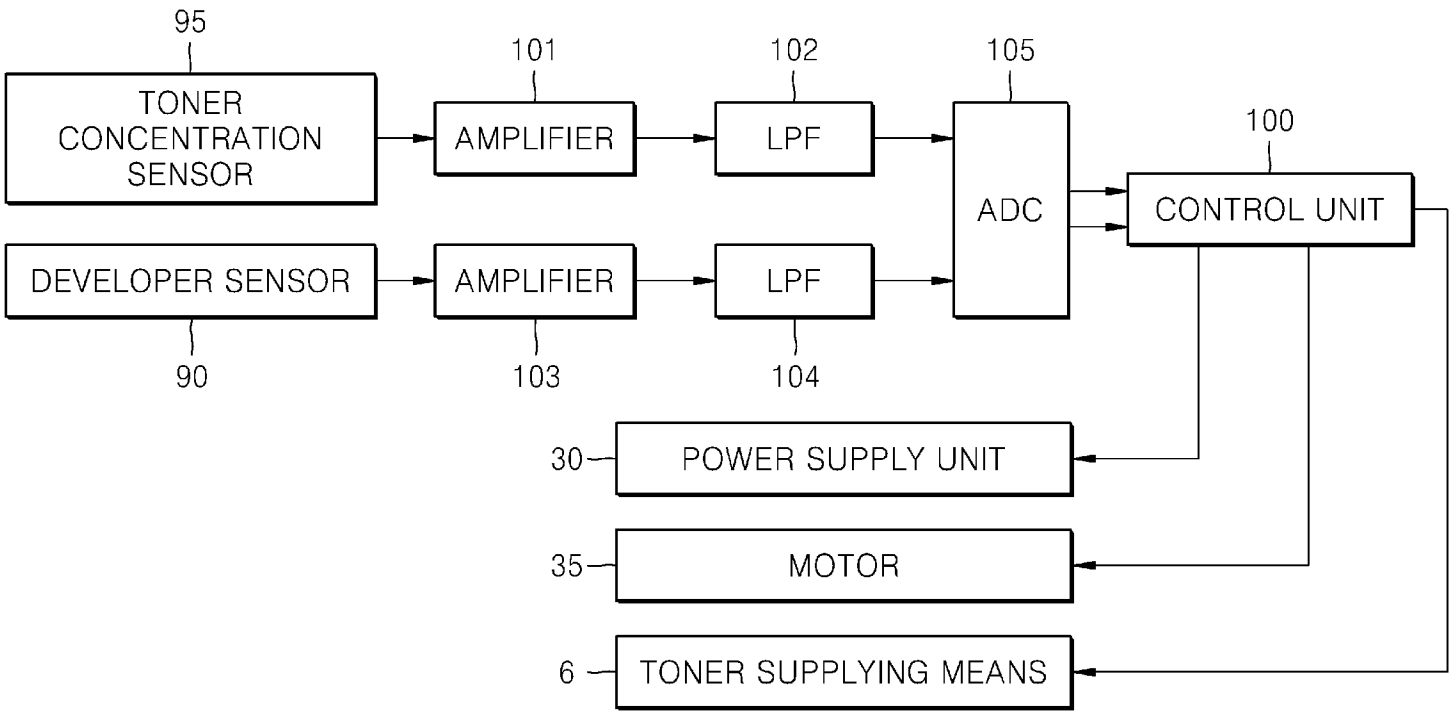
FIG. 8 is a block diagram showing control of image density.

FIG. 8 is a block diagram showing system to control image density by controlling a toner concentration, or a ratio of toner to developer. Referring to FIG. 8, the output signal of the toner concentration sensor 95 passes through an amplifier 101 and a low-pass filter (LPF) 102 and is input to an analog-digital converter (ADC) 105. The output signal of the developer sensor 90 passes through an amplifier 103 and a low-pass filter (LPF) 104 and is input to the ADC 105 to generate digital signals based on the analog input signals from the sensors 90 and 95. The control unit 100 controls the power supply unit 30, a motor 35 to rotate the mixer 3, and the toner supplying controller 6 based on the digitized outputs of the toner concentration sensor 95 and the developer sensor 90.

Figure 9:
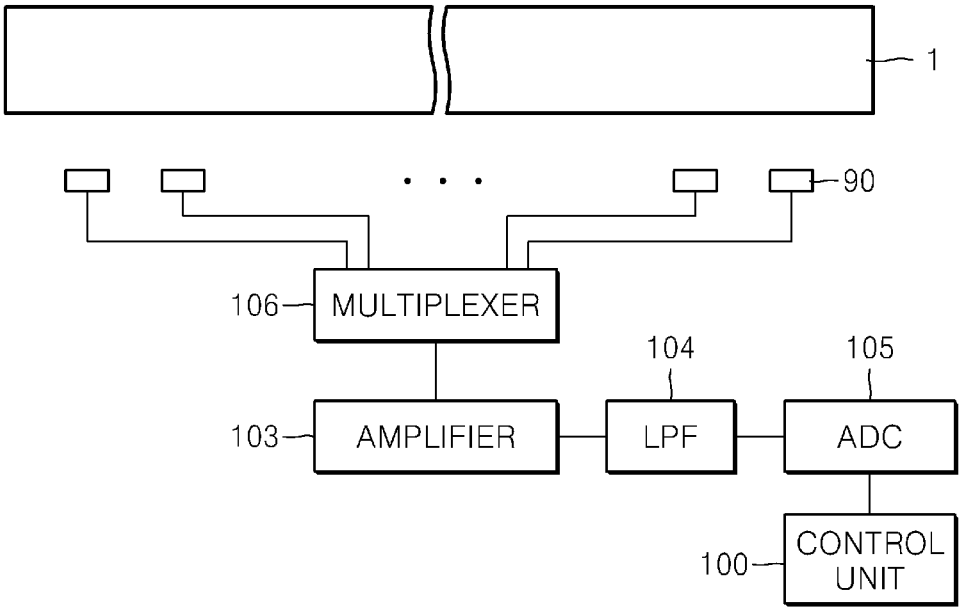
FIG. 9 is a diagram showing an embodiment in which a plurality of developer sensors are arranged for detection of developer mass per area (DMA)

During the initial use of an image forming device, toner may not be uniformly supplied in the lengthwise direction of the developing roller 1. The lengthwise direction of the roller may be defined as a direction parallel to the length axis or rotation axis of the roller. Furthermore, in the case of printing an image with a significant density variation in the lengthwise direction of the developing roller 1, the consumption rate of toner may vary in the lengthwise direction of the developing roller 1. Therefore, DMA may be detected differently based on a location on the developing roller 1 in the lengthwise direction that the developer sensor 90 is arranged to face. Referring to FIG. 9, a plurality of the developer sensors 90 may be arranged in the lengthwise direction of the developing roller 1, the output signals of the plurality of developer sensors 90 may be input to the ADC 105 via a multiplexer 106, the amplifier 103, and the LPF 104, and the digitized outputs of the plurality of developer sensors 90 may be input to the control unit 100. The control unit 100 may calculate a final value of DMA by calculating the average of the DMAs detected by the plurality of developer sensors 90. Alternatively, the control unit 100 may be able to supply toner and/or developer to different portions of the developing roller 1 in different densities.

Figure 10A:
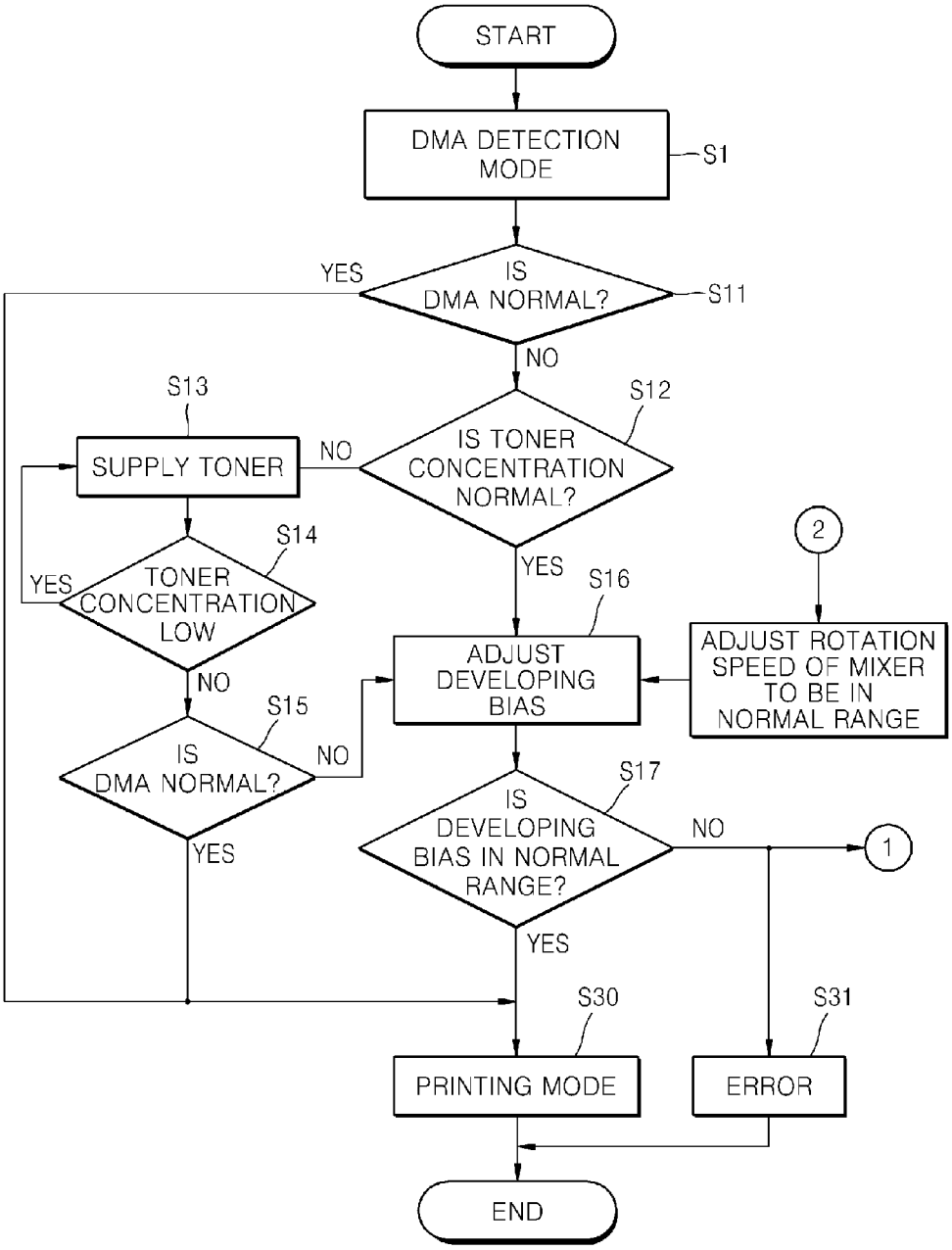
FIGS. 10A and 10B are flowcharts of methods of adjusting image density by controlling a developing bias according to an embodiment of the present general inventive concept.
Figure 10B:
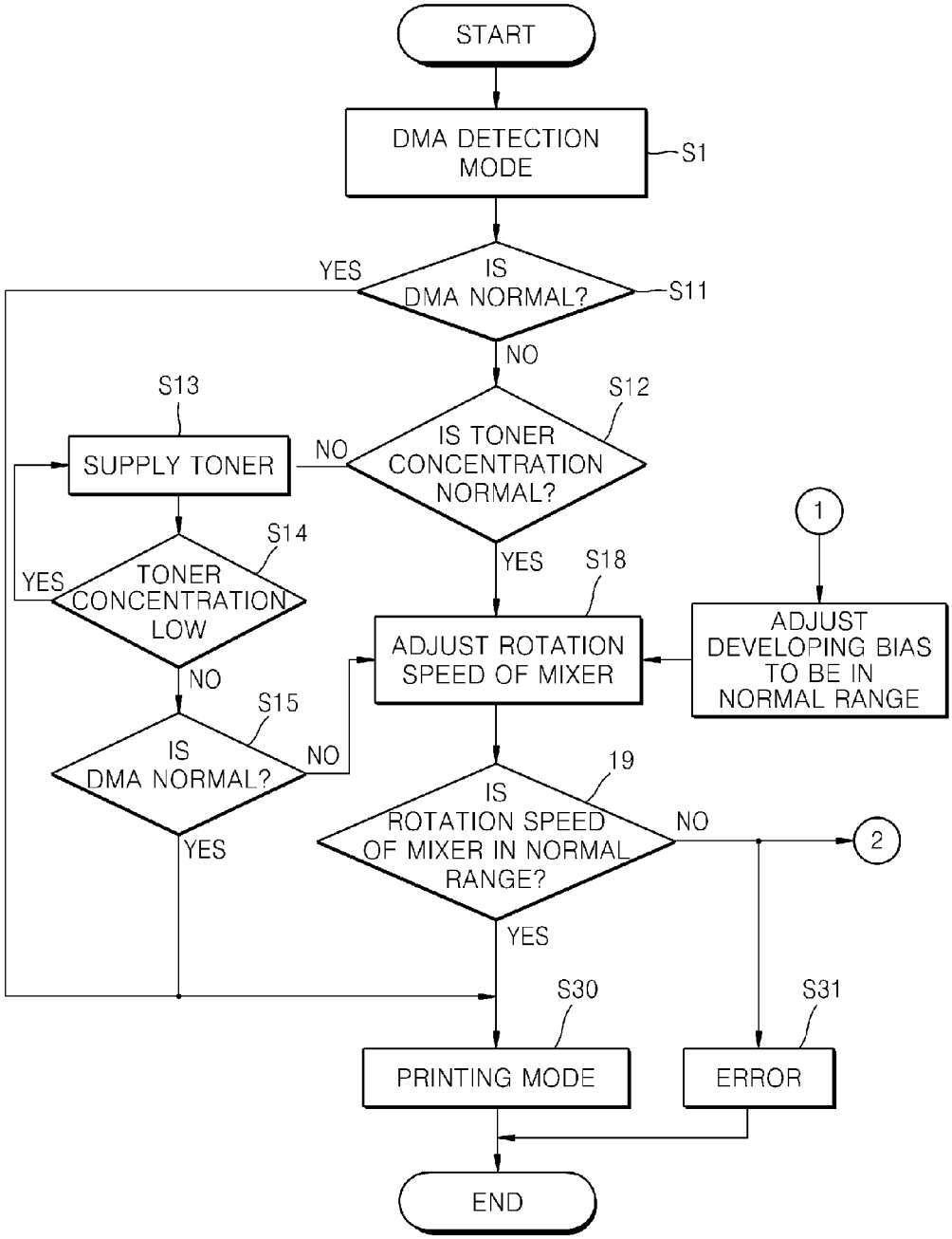

FIG. 10A is a flowchart of a method of adjusting image density by controlling a developing bias Vd according to an embodiment of the present general inventive concept, and FIG. 10B is a flowchart of controlling image density by controlling the rotating speed of the mixer 3 according to an embodiment of the present general inventive concept. Referring to FIGS. 10A and 10B, the methods of controlling image density according to the present general inventive concept will be described below. Reference numerals S1, S11, S12, S13, S14, S15, S30, and S31 are illustrated in both FIG. 10A and FIG. 10B to illustrate that a method according to the present general inventive concept may be performed by either adjusting a developing bias first (i.e., FIG. 10A) or adjusting a rotation speed of a mixer first (i.e. FIG. 10B).

To control image density, the control unit 100 is switched to a DMA detecting mode in operation S1. During the DMA detecting mode, the printing operations may be halted, and no charging bias may be applied to the charging roller 40. Furthermore, the exposure unit 50 does not operate. Therefore, toner does not move from the developing roller 1 to the photosensitive drum 10.

When the developing roller 1 rotates, a developer layer Ld, which is formed of the magnetic carrier and toner, is formed on the outer surface of the developing roller 1 as shown in FIG. 2. The power supply unit 30 applies a detecting voltage Vs to the developing roller 1. The control unit 100 determines in operation S11 whether a DMA is normal or not based on a value detected by the developer sensor 90.

When the developer sensor 90 detects that the DMA is normal, an image may be printed with normal image density under current conditions including the developing bias Vd and/or rotation speed of the mixer 3, and the control unit 100 may activate the printing mode S30. In other words, if the DMA is normal, density of an image to be printed will be as desired, and thus it is not necessary to confirm a value detected by the toner concentration sensor 95.

When the developer sensor 90 detects that the DMA is not normal, it means that the DMA is either greater or smaller than a normal value due to insufficient or excessive toner concentration, respectively, and thus an image may be printed with image density higher or lower than the normal image density.

If the DMA detected by the developer sensor 90 in operation S11 is not normal, the method proceeds in operation S12 to a toner concentration detecting mode in which the control unit 100 determines whether the toner concentration in the storage unit 4 is normal or not based on a value detected by the toner concentration sensor 95.

If the toner concentration sensor detects that the toner concentration is normal, then operation of the toner supplying controller 6 and the mixers 3 may be adjusted according to a determined scenario, as discussed below.

In a first case, the toner concentration sensor 95 may detect a normal toner concentration in the storage unit 4 due to an error in the value detected by the toner concentration sensor 95 in operation S12, the DMA detected in operation S11 may exceed a normal value range, and the toner concentration may actually be higher than normal. In a second case, the toner concentration sensor 95 may detect a normal toner concentration in the storage unit 4 due to an error of the toner concentration sensor 95, the DMA detected in operation S11 may the normal value range, and the toner concentration may actually be lower than normal. In a third case, the DMA detected in operation S11 may exceed the normal value range and there may be no error in the value detected by the toner concentration sensor 95 in operation S12.

In the first case, the DMA may actually exceed the normal value range. In the second and third cases, the DMA may be detected in operation S11 as exceeding the normal value range even though toner concentration in the storage unit 4 is normal or lower than normal due to an excessive amount of developer supplied to the developing roller 1 by the mixer 3. Furthermore, when toner is adhered to the magnetic carrier by an electrostatic force and is supplied to the developing roller 1, the toner may be excessively charged, and thus an excessive amount of the toner may adhere to the magnetic carrier. If a printing operation is performed based on the value detected by the toner concentration sensor 95, an excessive amount of toner may be developed to the photosensitive drum 10, and thus an image having density higher than desired may be printed. To reduce the amount of toner supplied to the photosensitive drum 10, the control unit 100 may control the power supply unit 30 in operation S16 to adjust the developing bias Vd to weaken the intensity of an electric field applied between the photosensitive drum 10 and the developing roller 1, as shown in FIG. 10A. As shown in FIG. 10B, the control unit 100 may also control the motor 35 in operation S18 to reduce the rotating speed of the mixer 3 to reduce the amount of developer supplied from the storage unit 4 to the developing roller 1.

In a fourth case, the toner concentration sensor 95 may detect a normal toner concentration in the storage unit 4 due to an error in the value detected by the toner concentration sensor 95, the DMA detected in operation S11 may be below the normal value range, and the toner concentration may actually be lower than normal. In a fifth case, the toner concentration sensor 95 may detect a normal toner concentration in the storage unit 4 due to an error in the value detected by the toner concentration sensor 95 in operation S12, the DMA detected in operation S11 may be below the normal value range, and the toner concentration may actually be higher than normal. In a sixth case, the DMA detected in operation S11 may be below the normal value range and there may be no error in the value detected by the toner concentration sensor 95 in operation S12.

In the fourth case, the DMA may be below the normal value range. In the fifth and sixth cases, the reason that the DMA detected in operation S11 is below the normal value range even though toner concentration in the storage unit 4 is normal or higher than normal may be that the insufficient amount of developer is supplied to the developing roller 1 by the mixer 3. Furthermore, when toner adheres to the magnetic carrier by an electrostatic force and is supplied to the developing roller 1, the toner may be insufficiently charged, and thus an insufficient amount of the toner may be adhered to the magnetic carrier. If a printing operation is performed based on the value detected by the toner concentration sensor 95, an insufficient amount of toner may be developed to the photosensitive drum 10, and thus an image having density lower than desired may be printed.

To increase the amount of toner supplied to the photosensitive drum 10, the control unit 100 may control the power supply unit 30 in operation S16 to adjust the developing bias Vd to strengthen the intensity of an electric field applied between the photosensitive drum 10 and the developing roller 1, as shown in FIG. 10A. In addition, as shown in FIG. 10B, the control unit 100 may control the motor 35 in operation S18 to increase the rotating speed of the mixer 3 to increase amount of developer supplied from the storage unit 4 to the developing roller 1.

As described above, even when there is an error in the detection of toner concentration in operation S12, an image with desired density may be printed by adjusting the developing bias Vd or the rotation speed of the mixer 3 based on a result of re-detecting the DMA.

Figure 13A:
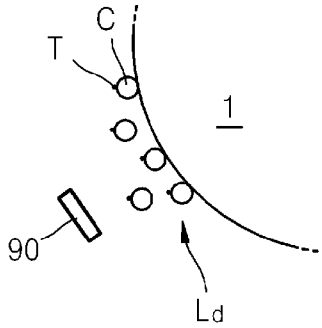
FIGS. 13A-13C illustrate the effects on the developer layer of the developing roller of adjusting developing bias and mixer speed.
Figure 13B:
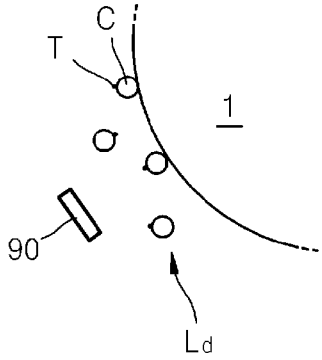
Figure 13C:
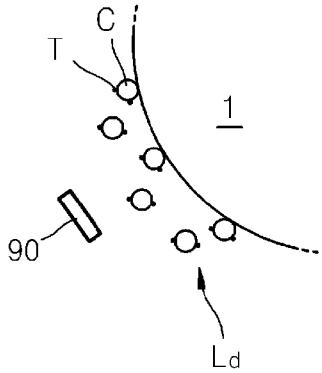

FIGS. 13A-13C illustrate the effects of adjusting the developing bias Vd and the rotation speed of the mixer 3, respectively, to adjust an amount of toner to be supplied to a print medium P. In FIG. 13A, the developer sensor 90 detects a DMA of developer layer Ld including toner T and carrier C without adjustments to the developing bias Vd or the rotation speed of the mixer 3.

As illustrated in FIG. 13B, if the control unit 100 determines based on the detected DMA and toner concentration that the DMA is too high, the speed of the mixer 3 may be decreased to supply less developer to the developer roller 1. Consequently, the concentration of developer may decrease. Alternatively, or in addition to adjusting the mixer 3 speed, the developing bias Vd may be adjusted to decrease an amount of toner that is transmitted to the print medium P. Consequently, as shown in FIG. 13C, the developer layer Ld may have a higher concentration of toner T downstream of the developing area. Each of the adjustment to the mixer 3 speed and the developing bias may change the capacitance characteristics detected by the developer sensor 90 if the developer sensor 90 is a capacitive sensor.

When the toner concentration detected in operation S12 is not normal, the control unit 100 may control the toner supplying controller 6 to supply toner from the toner supplying unit 5 to the storage unit 4. Accordingly, when toner concentration in the storage unit 4 is low, the toner concentration in the storage unit 4 may be restored to a normal concentration by supplying toner to the storage unit 4. Furthermore, when toner is excessively charged, charge potential of the toner may be restored to a normal level by supplying new toner. Furthermore, when toner is insufficiently charged, charge potential of the toner may be restored to a normal level by continuously rotating the mixer 3.

Next, toner concentration is detected again in operation S14. If it was determined in operation S12 that the toner concentration was low, and if it is determined in operation S14 that the toner concentration is still low, the control unit 100 controls the toner supplying controller 6 to supply toner from the toner supplying unit 5 to the storage unit 4 in operation S13, and toner concentration is detected again in operation S14. If it is determined in operation S14 that the toner concentration is not low, the DMA is detected again in operation S15 by the developer sensor 90.

If the DMA detected in operation S15 is in a normal range, the method proceeds to the printing mode in operation S30. In this case, it means either that there is no error in a value detected by the toner concentration sensor 95 in operation S12, or that, even if there is an error in a value detected by the toner concentration sensor 95 in operation S12, the DMA detected in the S11 is outside a normal range due to excessive or insufficient charging of the toner. Therefore, an image with desired density may be printed by adjusting the toner concentration in operations S13 and S14 without adjusting additional printing conditions such as the developing bias Vd or the rotation speed of the mixer 3.

If the DMA detected in operation S15 is not normal, the following cases may be suggested with respect to the abnormal DMA detection.

In a first case, although the toner concentration in the storage unit 4 is determined as normal in operation S14 due to an error in the value detected by the toner concentration sensor 95, the DMA detected in operation S15 may exceed the normal value range, and the toner concentration may actually be higher than normal. In a second case, although the toner concentration in the storage unit 4 is determined as normal in operation S14 due to an error in the value detected by the toner concentration sensor 95, the DMA detected in operation S15 may exceed the normal value range and the toner concentration may actually be lower than normal. In a third case, the DMA detected in operation S15 may exceed the normal value range and there may be no error in the value detected by the toner concentration sensor 95 in operation S14.

In a fourth case, although the toner concentration in the storage unit 4 may be determined as normal in operation S14 due to an error in the value detected by the toner concentration sensor 95, the DMA detected in operation S15 may be below the normal value range, and the toner concentration may actually be lower than normal. In a fifth case, although the toner concentration in the storage unit 4 is determined as normal in operation S14 due to an error in the value detected by the toner concentration sensor 95, the DMA detected in operation S15 may be below the normal value range, and the toner concentration may actually be higher than normal. In a sixth case, the DMA detected in operation S15 may be below the normal value range and there may be no error in the value detected by the toner concentration sensor 95 in operation S14.

The six cases stated above are the same as the six cases previously described above with respect to the case in which the toner concentration was in a normal range in operation S12. When a printing method is performed in the first case, the second case, or the third case, the amount of toner developed to the photosensitive drum 10 increases, and thus an image having a density higher than desired may be printed. To reduce the amount of toner developed to the photosensitive drum 10, the control unit 100 may control the power supply unit 30 in operation S16 to adjust the developing bias Vd to weaken the intensity of an electric field applied between the photosensitive drum 10 and the developing roller 1, as shown in FIG. 10. In addition, as illustrated in FIG. 10B, the control unit 100 may control the motor 35 in operation S18 to reduce the rotating speed of the mixer 3 to reduce the amount of developer supplied from the storage unit 4 to the developing roller 1.

Furthermore, when a printing method is performed in the fourth case, the fifth case, or the sixth case, the amount of toner developed to the photosensitive drum 10 decreases, and thus an image having a density lower than desired may be printed. To increase the amount of toner supplied to the photosensitive drum 10, the control unit 100 may control the power supply unit 30 in operation S16 to adjust the developing bias Vd to strengthen the intensity of an electric field applied between the photosensitive drum 10 and the developing roller 1, as shown in FIG. 10A. In addition, as illustrated in FIG. 10B, the control unit 100 may control the motor 35 in operation S18 to increase the rotating speed of the mixer 3 to increase the amount of developer supplied from the storage unit 4 to the developing roller 1.

As described above, even when there is an error in the detection of the toner concentration in operation S14, an image with a desired density may be printed by adjusting the developing bias Vd or the rotation speed of the mixer 3 based on a result of re-detecting the DMA.

As described above, the control unit 100 controls an image forming device based on a result of detection of the developer sensor 90, such that a printing operation is immediately performed when the DMA is in a normal range. If the DMA is not in a normal range and a value detected by the toner concentration sensor 95 is in a normal range, the control unit 100 controls the image forming device to adjust the developing bias Vd or the rotation speed of the mixer 3 and to perform a printing operation thereafter to embody the desired image density. If the DMA is not in a normal range and a value detected by the toner concentration sensor 95 is not in a normal range, the control unit 100 controls the image forming device to detect the DMA again after adjusting toner concentration in the storage unit 4 and to perform a printing operation if the re-detected DMA is normal. If the re-detected DMA is not in a normal range, the control unit 100 controls the image forming device to perform a printing operation after the developing bias Vd or the rotation speed of the mixer 3 is adjusted to embody the desired image density.

As described above, according to the method of adjusting image density according to the present embodiment, toner concentration in the storage unit 4 may be maintained constant and the density of a printed image may be maintained uniform by adjusting the developing bias Vd or the rotation speed of the mixer 3 based on values detected by the toner concentration sensor 95 and the developer sensor 90. Furthermore, based on combinations of a value detected by the developer sensor 90 and a value detected by the toner concentration sensor 95, image density errors due to erroneous detection of the toner concentration sensor 95 may be prevented.

The adjustable range of the developing bias Vd is limited. For example, the developing bias Vd may not exceed a voltage for generating discharge between the developing roller 1 and the photosensitive drum 10. Furthermore, the developing bias Vd should be able to provide an electric field between the developing roller 1 and the photosensitive drum 10, where it is necessary for the electric field to have the minimum intensity for moving toner from the developing roller 1 to the photosensitive drum 10. Therefore, in FIG. 10A, if it is determined in operation S17 that the developing bias Vd adjusted in operation S16 is outside the adjustable range, a system error message may be generated in operation S31 and the DMA detecting mode may be terminated. Furthermore, if the adjusted developing bias Vd exceeds the adjustable range, the developing bias Vd may be restored to the level prior to the adjustment or a level within the adjustable range, and the rotation speed of the mixer 3 may be adjusted.

The adjustable range of the rotation speed of the mixer 3 is also limited. For example, the maximum rotation speed of the mixer 3 may be limited by the specification of the motor 35 that drives the mixer 3, the specification of a shaft supporting member that supports the mixer 3, and the rotation noise of the mixer 3. The minimum rotation speed of the mixer 3 may be limited by the processing speed, that is, a printing speed. Therefore, in FIG. 10B, if it is determined in operation S19 that the adjusted rotation speed of the mixer 3 is outside the adjustable range, a system error message may be generated in operation S31 and the DMA detecting mode may be terminated. Furthermore, if the adjusted rotation speed of the mixer 3 exceeds the adjustable range, the rotation speed of the mixer 3 may be restored to the level prior to the adjustment or a level within the adjustable range, and the developing bias Vd may be adjusted.

Figure 11A:
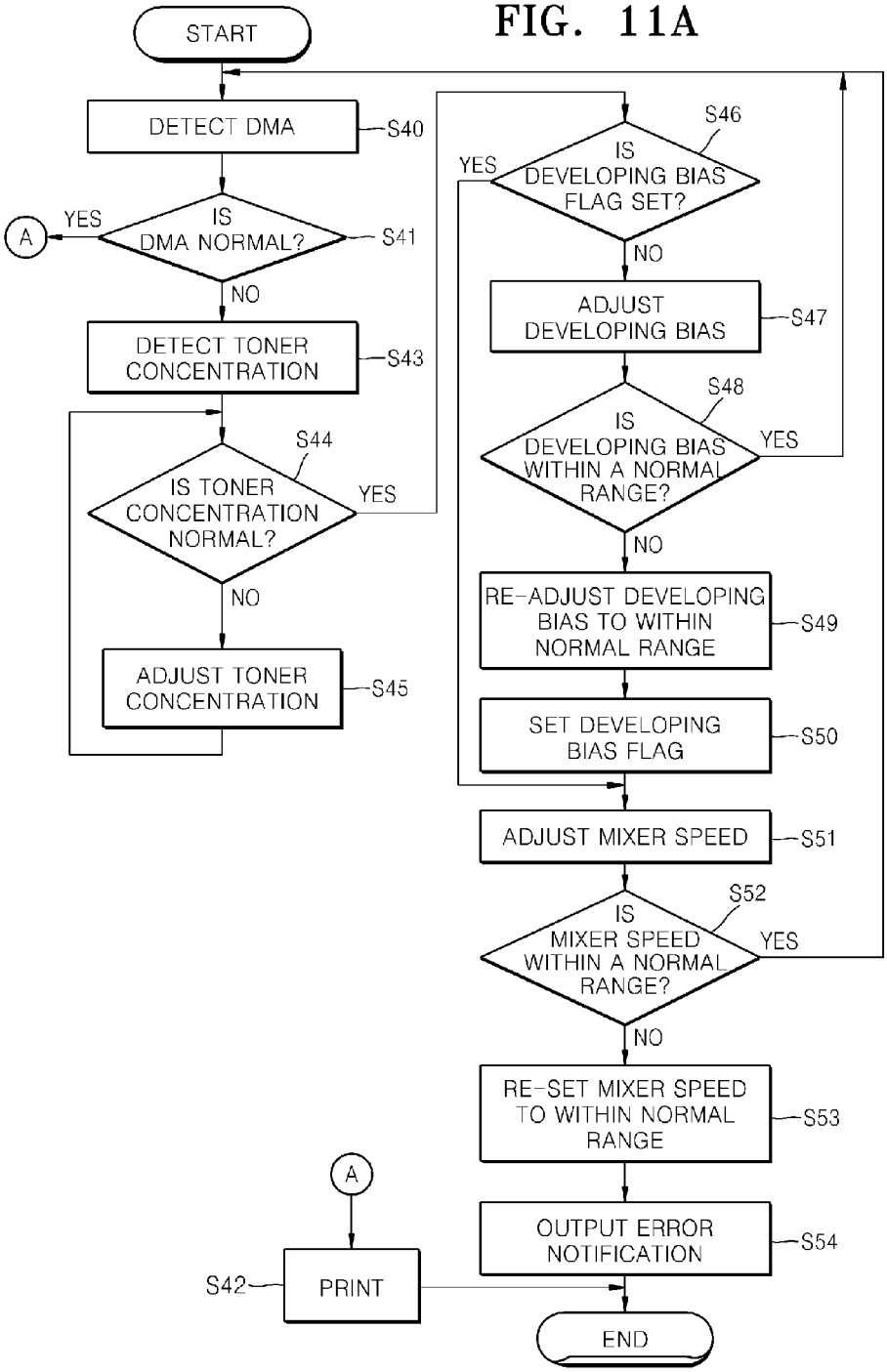
FIGS. 11A and 11B are flowcharts of methods of adjusting image density according to another embodiment of the present general inventive concept.
Figure 11B:
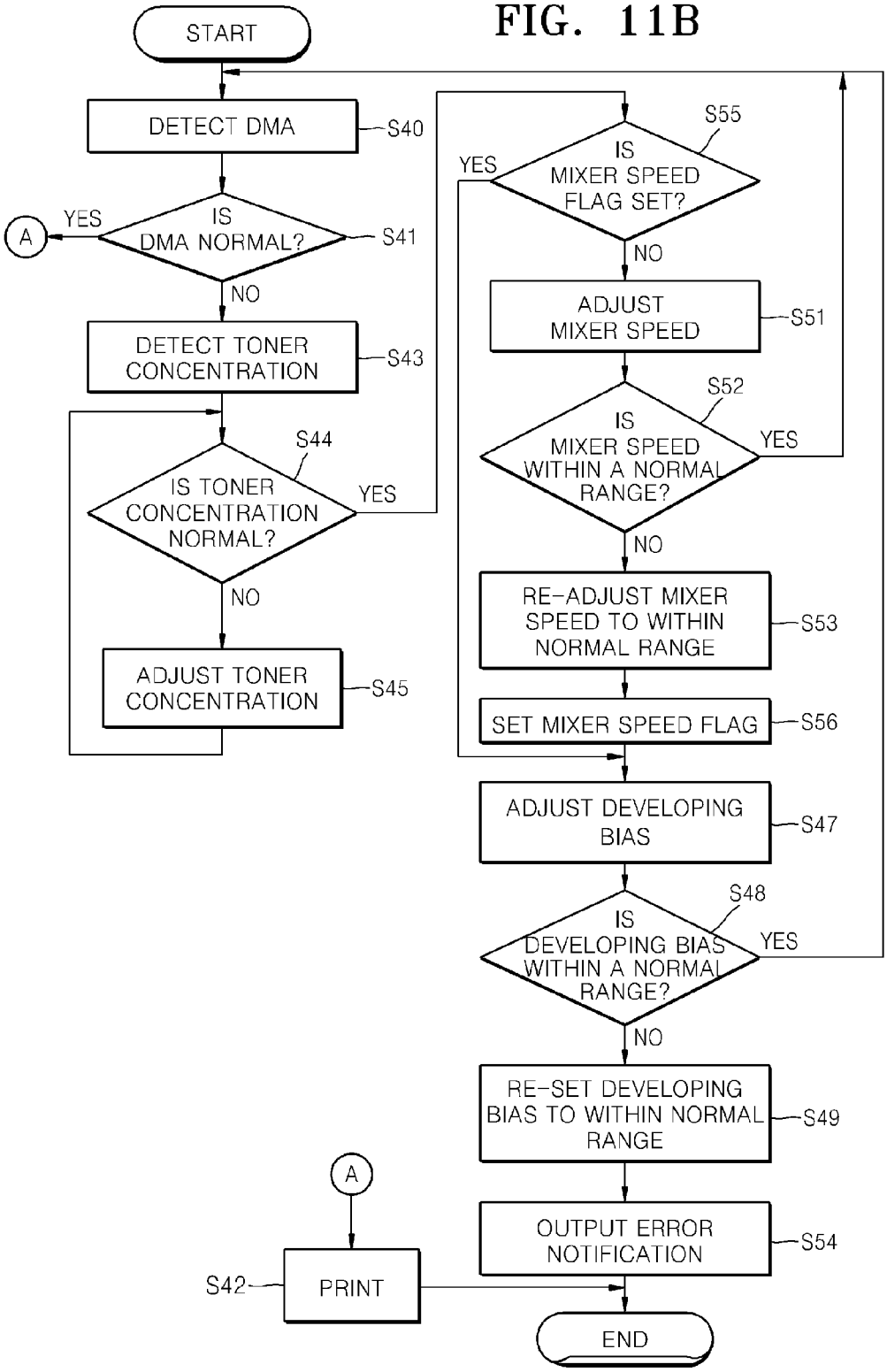

FIGS. 11A and 11B illustrate flow diagrams of methods similar to that of FIGS. 10A and 10B to adjust an image density of an image formed on a print medium P. Referring to FIG. 11A, in operation S40, the developer mass area (DMA) is detected by the developer sensor 90. If it is determined in operation S41 that the DMA is normal, the image is printed in operation S42 without adjusting the print characteristics.

On the other hand, if it is determined in operation S41 that the DMA is outside a normal range, then the toner concentration may be detected in operation S43 by the toner concentration sensor 95. If it is determined in operation S44 that the toner concentration is not normal, the toner supply may be adjusted in operation S45. For example, if it is determined that the concentration of toner is too high, the control unit 100 may control the toner supplying controller 6 to decrease the amount of toner supplied to the storage unit 4. After the toner supply is adjusted in operation S45, it may again be determined whether the toner concentration is normal. This process may be repeated as often as necessary unit the toner concentration is determined as normal.

When it is determined that the toner concentration is normal, the control unit 100 may detect in operation S46 whether a developing bias flag has been set. The developing bias flag may indicate when the developing bias Vd has been adjusted to a limit of its normal range. If the developing bias flag has been set, the control unit 100 may skip to operation S51 to adjust the mixer speed. On the other hand, if the developing bias flag has not been set, then the developing bias may be adjusted in operation S47 to change how much toner is supplied to the print medium P from the developer roller 1. For example, if it is determined that the DMA is above normal and the toner concentration is normal, then the developing bias Vd may be decreased so that less toner is supplied from the developing roller 1 to the print medium P.

In operation S48, it may be determined whether, after being adjusted, the developing bias Vd is still within a normal range. If it is, then the control unit 100 may repeat the process beginning at operation S40 to determine whether the adjustment of the developing bias Vd in operation S47 resulted in a normal DMA. On the other hand, if it is determined in operation S48 that the developing bias Vd has been adjusted outside a normal range, then the controller may re-adjust the developing bias in operation S49 to be within the normal range. In addition, a developing bias flag may be set in operation S50 to indicate that the developing bias is adjusted to a limit of its normal range. The flag may include one or more bits, bytes, or other program data read by the control unit.

After the developing bias flag is set in operation S50, the control unit 100 may adjust a speed of a mixer 3 in operation S51. For example, if it is determined that the DMA is low, then the mixer speed may be increased to provide a higher volume of developer to the developing roller 1.

In operation S52, it may be determined whether the mixer speed is within a normal range. If so, then the DMA may be detected in operation S40. If, however, the mixer speed has been adjusted in operation S51 to be outside the normal range, the control unit 100 may re-adjust the mixer speed in operation S53 to be within the normal range. In addition, since both the developing bias Vd and the mixer speed are at a limit of a normal range, and since the DMA is still detected as outside a normal range, the control unit 100 may cause an error notification to be generated in operation S54 to indicate to a user, a host device, or another electrical system that the DMA cannot be corrected without adjusting print characteristics such as the mixer speed and the developing bias outside normal ranges.

Although FIG. 11A illustrates a method in which the developing bias Vd is adjusted first, then the mixer speed is adjusted, the reverse may occur. FIG. 11B is similar to FIG. 11A, except the mixer speed is adjusted first, a mixer speed flag may be set in operation S56 to indicate that the mixer speed is at a limit of its normal range, the mixer speed flag may be detected in operation S55. After the mixer speed flag is set, the developing bias Vd may be adjusted.

FIGS. 10A, 10B, 11A, and 11B illustrate examples of adjusting a developing bias Vd and mixer speed to adjust an image density. However, these methods are merely examples of the present general inventive concept, and other equivalent methods may be utilized to achieve a similar result.

Although a monochrome image forming device and a method of adjusting image density for the monochrome image forming device are described in the above embodiment, an image forming device and a method of adjusting image density according to the present general inventive concept may be also applied to a single-pass type color developing device having a tandem configuration or a multi-pass type color developing device, in which a single photosensitive body is developed a plurality of times and is sequentially transferred to an intermediate transfer body.

While the present general inventive concept has been particularly shown and described with reference to exemplary embodiments thereof, it will be understood by those of ordinary skill in the art that various changes in form and details may be made therein without departing from the spirit and scope of the present general inventive concept as defined by the following claims.

What is claimed is:

1. An image forming device to print an image by receiving a developer including toner and a magnetic carrier from a storage unit, to form a developer layer on a surface of a developing roller by using the developer, and to move and adhere the toner from the developer layer to a photosensitive body by applying developing bias to the developing roller, the image forming device comprising:

a toner supplying unit to supply the toner to the storage unit;

a mixer to supply the developer in the storage unit to the developing roller;

a developer sensor to detect the amount of developer on the surface of the developing roller;

a toner concentration sensor to detect toner concentration in the developer stored in the storage unit; and a control unit to adjust at least one of a developing bias and a rotation speed of the mixer based on a value detected by the developer sensor and a value detected by the toner concentration sensor such that a printed image has uniform density, wherein the developer sensor is a capacitive sensor to detect a thickness of the developer layer, the toner concentration sensor is a magnetic sensor to detect concentration of the toner indirectly by detecting the amount of the magnetic carrier, and wherein the developer sensor includes a plurality of developer sensors arranged in a lengthwise direction of the developing roller.

2. The image forming device of claim 1, wherein, if the detected amount of the developer is outside a normal range and the detected toner concentration is within a normal range, the control unit adjusts at least one of the developing bias and the rotation speed of the mixer.

3. The image forming device of claim 1, wherein, if both the detected amount of the developer and the detected toner concentration are outside the normal ranges, the control unit controls the toner supplying unit to supply new toner to the storage unit, detects toner concentration again by using the toner concentration sensor, detects the amount of the developer again by using the developer sensor if the re-detected toner concentration is within the normal range, and adjusts at least one of the developing bias and the rotation speed of the mixer if the re-detected amount of the developer is outside the normal range.

4. The image forming device of claim 1, wherein, if one of the developing bias and the rotation speed of the mixer is outside an adjustable range, the control unit adjusts the other one of the developing bias and the rotation speed of the mixer.

5. A method of adjusting image density for an image forming device to print an image by receiving a developer including toner and a magnetic carrier from a storage unit, forming a developer layer on a surface of a developing roller by using the developer, and moving and adhering the toner from the developer layer to a photosensitive body by applying a developing bias to the developing roller, the method comprising:

detecting the amount of developer on the surface of the developing roller by using a developer sensor;

detecting toner concentration in the developer stored in the storage unit by using a toner concentration sensor; and adjusting at least one of the developing bias and a rotation speed of a mixer based on a value detected by the developer sensor and a value detected by the toner concentration sensor, such that a printed image has uniform density, wherein the developer sensor is a capacitive sensor to detect a thickness of the developer layer, the toner concentration sensor is a magnetic sensor to detect concentration of the toner indirectly by detecting the amount of the magnetic carrier, and wherein the developer sensor includes a plurality of developer sensors arranged in a lengthwise direction of the developing roller.

6. The method of claim 5, wherein the adjusting of at least one of the developing bias and the rotation speed of the mixer comprises adjusting at least one of the developing bias and the rotation speed of the mixer if the detected amount of the developer is outside a normal range and the detected toner concentration is within a normal range.

7. The method of claim 5, wherein the adjusting of at least one of the developing bias and the rotation speed of the mixer comprises:

supplying new toner to the storage unit if both the detected amount of the developer and the detected toner concentration are outside the normal ranges;

detecting toner concentration again by using the toner concentration sensor;

detecting the amount of the developer again by using the developer sensor if the re-detected toner concentration is within the normal range; and adjusting at least one of the developing bias and the rotation speed of the mixer if the re-detected amount of the developer is outside the normal range.

8. The method of claim 5, wherein the adjusting of at least one of the developing bias and the rotation speed of the mixer comprises adjusting one of the developing bias and the rotation speed of the mixer if the other one of the developing bias and the rotation speed of the mixer is outside an adjustable range.

9. The method according to claim 5, wherein adjusting the at least one of the developing bias and the rotational speed of the mixer comprises:

if the developer amount is detected as normal, not adjusting either of the rotational speed of the mixer and the developing bias;

if the developer amount is detected as abnormal and the toner concentration is detected as normal, adjusting one of the rotational speed of the mixer and the developing bias until the developer amount is detected as normal, and if the one of the rotational speed of the mixer and the developing bias is adjusted to a limit of a normal operating range and the developer amount is still detected as abnormal, adjusting the other of the rotational speed of the mixer and the developing bias until the developer amount is detected as normal.

10. The method according to claim 5, wherein if the developer amount is detected as abnormal and the toner concentration is detected as abnormal, before adjusting the one of the developing bias and the rotational speed of the mixer, adjusting an amount of toner supplied to the storage area until the toner concentration is detected as normal.

11. The method according to claim 5, wherein detecting an amount of developer includes averaging a plurality of detected amounts of developer from a plurality of developer sensors.

12. An image forming device, comprising:

a storage area to store developer including toner and carrier;

a toner concentration sensor to detect a toner concentration level in the storage area;

a developing roller to transmit toner from the storage area to a printing medium;

a developer sensor to detect an amount of developer on an outer surface of the developing roller;

a mixer to mix the developer in the storage area and to supply the developer to the developing roller; and a control unit to receive detection signals from each of the toner concentration sensor and the developer sensor and to adjust at least one of a developing bias of the developing roller and a mixing speed of the mixer according to the received detection signals, wherein the developer sensor is a capacitive sensor to detect a thickness of the developer layer, the toner concentration sensor is a magnetic sensor to detect concentration of the toner indirectly by detecting the amount of the magnetic carrier, and wherein the developer sensor includes a plurality of developer sensors arranged in a lengthwise direction of the developing roller.

13. The image forming device according to claim 12, wherein:

if the developer sensor detects a normal amount of developer, the control does not adjust either of the mixing speed or the developing bias to adjust an image density of an image on the printing medium, and if the developer sensor detects an abnormal amount of developer, the controller adjusts one of the developing bias and the mixing speed until the developer sensor detects a normal amount of developer, and if the one of the developing bias and the mixing speed is adjusted to a limit of a normal operating range and the developer sensor still detects an abnormal developer amount, then the control unit adjusts the other of the developing bias and the mixing speed until the developer sensor detects a normal amount of developer.

14. The image forming device according to claim 12, further comprising a toner supply controller to control an amount of toner supplied to the storage area, wherein, if the developer sensor detects an abnormal amount of developer and the toner concentration sensor detects an abnormal concentration of toner, the control unit controls the toner supply controller to adjust an amount of toner supplied to the storage area, and if the developer sensor detects an abnormal amount of developer and the toner concentration sensor detects a normal concentration of toner, the controller adjusts one of the developing bias and the mixing speed until the developer sensor detects a normal amount of developer, and if the one of the developing bias and the mixing speed is adjusted to a limit of a normal operating range and the developer sensor still detects an abnormal developer amount, then the control unit adjusts the other of the developing bias and the mixing speed until the developer sensor detects a normal amount of developer.

* * * * *